United States Patent [19]

Takeyama et al.

[11] 4,388,757

[45] Jun. 21, 1983

[54] METHOD FOR MANUFACTURING ELECTRIC SWITCHING BLOCK OF ELECTROMAGNETIC RELAY

[75] Inventors: Hidetoshi Takeyama, Hisai; Siro Sakamoto; Koji Sagawa, both of Tsu; Tokio Tanishi, Mie; Hiroaki Aihoshi, Tsu; Takao Morimoto, Mie, all of Japan

[73] Assignees: Matsushita Electric Works, Ltd., Osaka, Japan; Hans Sauer, Deisenhofen, Fed. Rep. of Germany; a part interest

[21] Appl. No.: 219,836

[22] Filed: Dec. 24, 1980

[30] Foreign Application Priority Data

Jul. 31, 1980 [JP] Japan ..... 55-106240

[51] Int. Cl.[3] ..... H01H 11/04

[52] U.S. Cl. ..... 29/882; 29/883; 29/884

[58] Field of Search ..... 29/602 R, 883, 884, 29/882, 418, 622

[56] References Cited

U.S. PATENT DOCUMENTS

| | | | |
|---|---|---|---|
| 3,728,981 | 4/1973 | Paullus | 29/882 |
| 4,197,636 | 4/1980 | Osanai | 29/884 X |
| 4,288,141 | 9/1981 | Leather | 29/882 X |

*Primary Examiner*—Carl E. Hall

*Attorney, Agent, or Firm*—Burns, Doane, Swecker & Mathis

[57] ABSTRACT

Method for manufacturing an electric switching block of an electromagnetic relay wherein a rocking armature end or ends of an electromagnetic block drives respective movable contactor spring plates between opposing fixed contact terminals in respective switching sections of the switching block.

1 Claim, 10 Drawing Figures

Fig. 1A
PRIOR ART
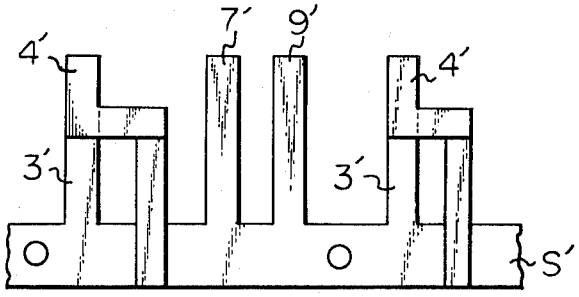
Fig. 1B
PRIOR ART
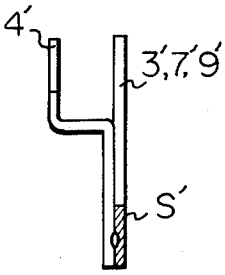
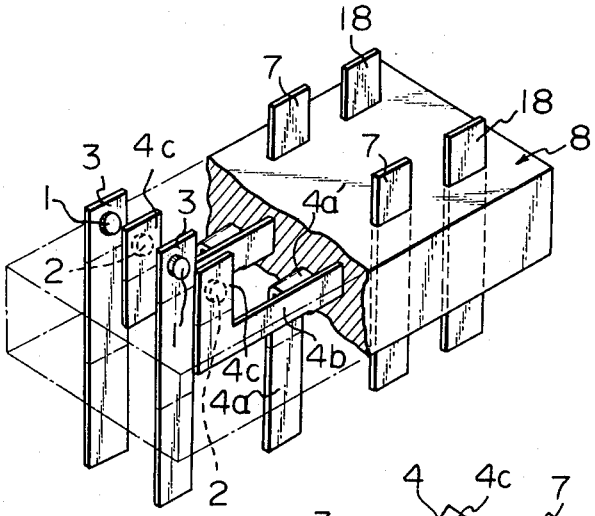
Fig. 2
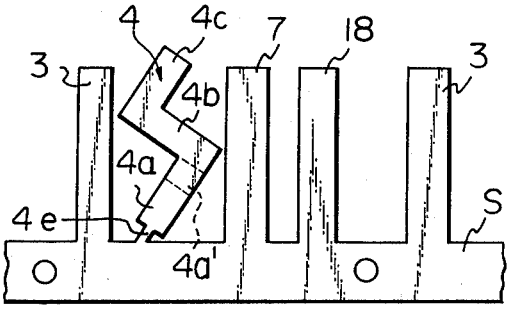
Fig. 3

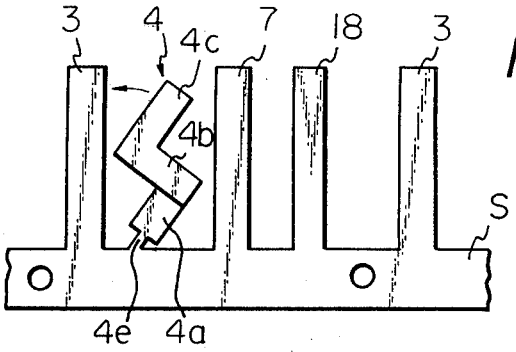
Fig. 4
Fig. 5A
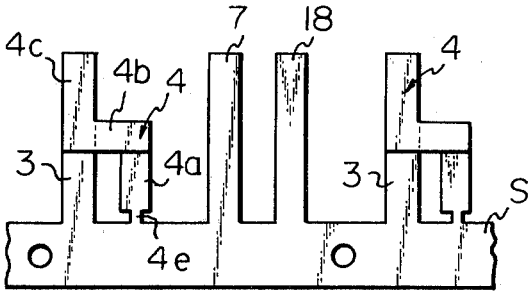
Fig. 5B
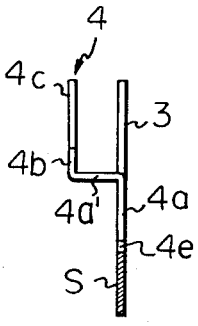
Fig. 6
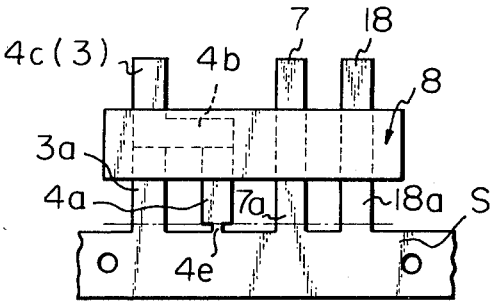

Fig. 7
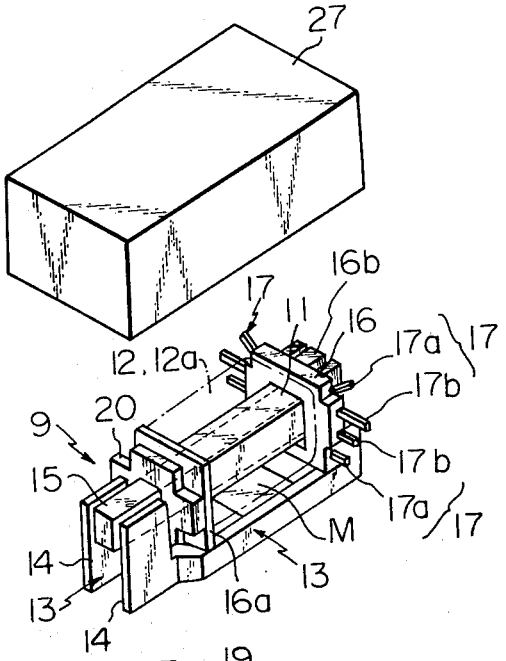
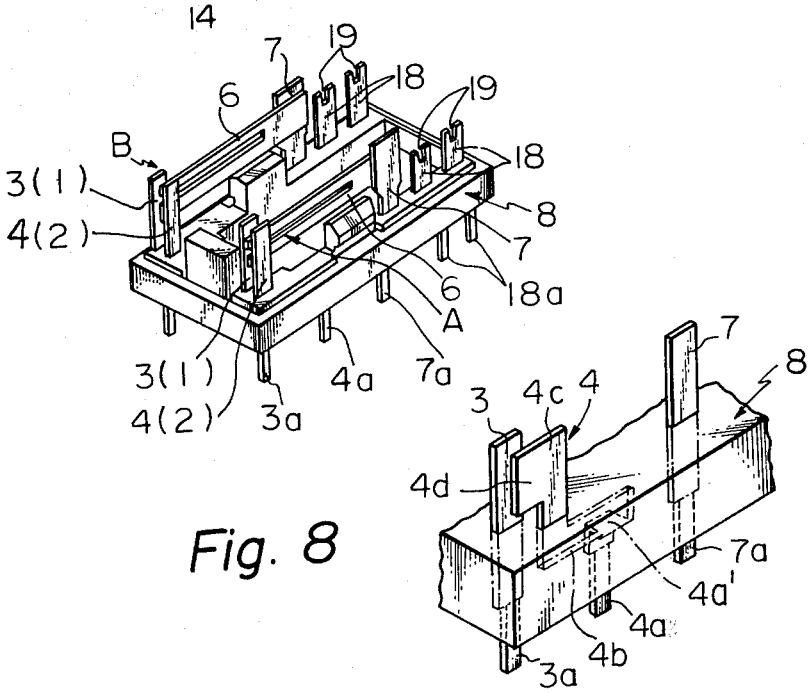
Fig. 8

METHOD FOR MANUFACTURING ELECTRIC SWITCHING BLOCK OF ELECTROMAGNETIC RELAY

BACKGROUND OF THE INVENTION

This invention relates generally to methods for manufacturing electromagnetic relays such as the polarized type which comprising an electromagnet block and an electric switching block and, more particularly, to improvements in methods for manufacturing specifically the electric switching block of such electromagnetic relays.

In conventional electromagnetic relays of the kind referred to respective terminals of a plurality of switch sections each include a pair of normally-opened (NO) and normally-closed (NC) side fixed contact terminals and a movable contact terminal as well as terminals for electromagnetic coil or coils. The terminals are integrally embedded in a base body of an insulative material by being molded, typically. The pair of fixed contacts as well as their terminals are deviated from each other so as not to oppose each other. Also provided are a pair or movable contacts on both surfaces of a movable contactor spring plate secured at a base end to a movable contact terminal. These movable contacts are also deviated from one another so as to be engageable with each of the deviated fixed contacts, respectively. This is because, if the fixed contacts are opposed to each other, an upper die normally required for molding the base body cannot be used since the both contacts which are generally opposing through a very small distance get in the way of downward stroke of the the upper die member of the molding die. The latter defines the upper surface of the base body. Further, the integral holding of the terminals with the molding made base body becomes practically impossible. However, when the fixed contact terminals are deviated as in the foregoing, the entire base body can be molded by using a pair of split side cores. On the other hand, there has been a problem in the above arrangement in that, as the movable contacts are disposed as deviated at positions mutually different in the distance from the base end of the movable contactor spring plate, the resiliency constant of the spring plate at each position of the NO and NC side movable contacts is caused to be different from each other consequently a non-uniformity will arise in the contacting pressure of the respective movable contacts with the fixed contacts, whereby uniform reliability of contacting performance on both of the NO and NC sides cannot be achieved and hence the switching performances of the entire relay are deteriorated.

In manufacturing such electromagnetic relay as above, further, the respective contact terminals specifically in the switching block have been prepared separately from each other or at least one of the fixed contact terminals of the deviated positions has been prepared separately from the other fixed contact terminal and the movable contact terminal. On the other hand, at least the latter two terminals could be prepared in a common single metal strip. Thus, the manufacturing steps would be rather complicated and certain positional errors could have been involved in the deviated relationship between the respective pairs of the NO side and NC side contacts, resulting in deteriorations in the switching performances. Even in the event when the pair of fixed contact terminals or at least their fixed contacts are disposed to oppose each other, as shown in FIGS. 1A and 1B, the fixed contact terminal 3' and movable contact terminal 7' are prepared jointly in a single metal strip S' together with a coil terminal 9'. However, the other fixed contact terminal 4' must be prepared separately from the strip S' since it has been practically impossible to provide in the same strip the latter terminal 4' which is to be disposed in the opposing relation with a predetermined space to the former fixed contact terminal 3'. Yet, so long as at least the terminals 3', 7' and 9' are formed in the strip S', the manufacture of the relay is adapted to an automatic line operation and, in order that the separately prepared terminal 4' is incorporated in such line operation of the strip S', the terminal 4' is formed substantially in a reverse Z-shape as seen in FIG. 1A and is bent at the intermediate position as seen in FIG. 1B. Thus, its one end can be parallelly opposed to an end of the terminal 3' through the predetermined space while the other end can be joined to the strip S' at a position on the strip between the both terminals 3' and 7'. In performing the line operation, further, a large number of sets respectively including the terminals 3', 7' and 9' are sequentially provided in the strip S' which is usually provided in a hoop and arranged to be a long rectangular shape. Thus respective two sets of the terminals will be parallelly opposed for manufacturing both two-position transfer (2T) type and four-position transfer (4T) type electromagnetic relays. Accordingly, the joining work of the separately prepared terminals 4' must be performed for the respective large number of sets with a great deal of care for avoiding any positional error in the opposing and spaced relationship between the fixed contacts, and the manufacturing is rendered much complicated in steps, resulting in higher costs.

The present invention has been suggested to remove such problems as in the foregoings of the conventional method for manufacturing the electromagnetic relays of the kind referred to.

A primary object of the present invention is, therefore, to provide a method for manufacturing specifically the electric switching block of the electromagnetic relay having fixed contact terminals mutually opposing their contact carrying parts, which can be performed easily and yet with a higher assembling precision.

A related object of the present invention is to provide the method of manufacturing the electric switching block of the electromagnetic relays which can be performed through simplified steps and suitable to be adapted to an automatic mass-production.

The Drawings

Other objects and advantages of the present invention will be made clear in the following descriptions detailed with reference to certain preferred embodiments of the invention shown in accompanying drawings in which:

FIGS. 1A and 1B are respectively a fragmental plan view and side view of a metal strip or hoop of respective terminals employed in conventional manufacturing method for the electric switching block of the relay;

FIG. 2 is a perspective view schematically showing an electric switching block with a base body partly omitted and manufactured through a method according to the present invention;

FIGS. 3 to 6 show respective sequences of steps of the manufacturing method for the electric switching block of FIG. 2;

FIG. 7 is a perspective view showing a practical example in completed state of the switching block manufactured according to the present invention, as well as an associated electromagnet block and covering case shown as disassembled; and FIG. 8 is a fragmentary perspective view of another example of fixed contact terminal arrangement according to the present invention.

DETAILED DESCRIPTION OF PREFERRED EMBODIMENTS OF THE INVENTION

While the present invention shall now be explained with reference to the preferred embodiments shown in the drawings, it should be appreciated that the intention is not to limit the invention to those particular embodiments but rather to include all possible alterations, modifications and equivalent arrangements possible within the scope of appended claims.

Referring first briefly to a structure of the electromagnetic relay to which the present invention relates with reference to FIG. 7 showing a 2T type polarized electromagnetic relay, an electric switching block comprises two switching or transfer sections A and B respectively including a pair of fixed contacts 1 and 2 respectively secured adjacent one end of respective fixed contact terminals 3 and 4. A movable contact spring plate 6 includes, on both surfaces at one end, a pair of movable contacts. A movable contact terminal 7 secures the other end of the plate 6. The two sections A and B are disposed on the upper surface of an insulative base 8 respectively adjacent each side edge while passed through the base so as to project respective terminal pins 3*a*, 4*a* and 7*a* at the other end of the respective terminals 3, 4 and 7 out of the other lower surface of the base. The fixed contact terminal 4 in each of the switching sections A and B is formed to be substantially in a reverse Z-shape as angled at an intermediate portion perpendicular to the lower end pin 4*a* and the other upper end. In order to have the opposing terminals 3 and 4 spaced from each other by a predetermined distance for movably inserting between them the one end carrying the movable contacts of the movable contact spring plate 6, the terminal 4 is bent twice at positions spaced by a length 4*a*′ corresponding to the predetermined distance at the intermediate portion embedded in the base, while the terminal pin 3*a* or 4*a* is preferably disposed in alignment with the other in the direction of the side edge.

An electromagnet block 9 for driving the respective movable contact spring plates 6 in the two switching sections A and B is mounted on the upper surface of the base 8 and between the respective switching sections A and B. This electromagnet block 9 comprises (i) a coil bobbin 11, (ii) a coil divided into two sections 12 and 12*a* in the present instance and wound on the bobbin 11, (iii) a pair of yokes 13 extending substantially parallel along and below the coil 12 and 12*a* and (iv) an armature 15. The yokes 13 are coupled respectively at the intermediate position to respective different pole surfaces of a permanent magnet M disposed below the coil so as to form a magnetic gap by respective ends 14 of the yokes 13 opposing each other at one axial end of the coil. The armature 15 passes through the coil bobbin 11 to dispose an end thereof in the magnetic gap of the yokes. The armature 15 is pivotably held at the other end by the other axial end of the bobbin 11 so that, upon an excitation of the coils 12 and 12*a*, the end disposed in the magnetic gap will be alternately rocked as attracted to either of the oppositely polarized ends 14 of the yokes 13. At both ends of the coil bobbin 11, there are provided flanges 16 and 16*a*, the flange 16 pivotably holding the other end of the armature 15 is made to be relatively thicker than the other flange 16*a*. A pair of coil lead terminals 17 respectively formed substantially in U-shape are embedded at their bent part in each of both lateral side edges of the thicker flange 16 so as to project their both ends 17*a* and 17*b* of the side edges. Both end leads of the respective coil sections 12 and 12*a* are connected to the respective projected ends 17*a* of the terminals 17 on both side edges of the flange 16. The other projected ends 17*b* on each side edge of the flange 16 are made relative longer than the ends 17*a* and are connected to respective upper ends of a pair of coil terminals 18 provided in each of the switching sections A and B of the switching block. The terminals 18 are integrally embedded in the base 8 so as to project their terminal pins 18*a* at the other lower end out of the lower surface of the base 8. The upper ends of the coil terminals 18 are provided respectively with a notch 19 so that the longer projected ends 17*b* of the coil lead terminals 17 will be inserted in the respective notches 19 of the coil terminals 18 to be connected therewith simultaneously with the mounting of the electromagnet block 9 on the base 8 of the switching block. An electrically insulative and non-magnetic card 20 having lateral side arms is fitted to the armature 15 adjacent its end inserted in the magnetic gap of the yokes 13 so as to engage the arms with the respective movable contact spring plates 6 when the block 9 is mounted on the switching block, whereby the alternate attracted movements of the armature 15 are transmitted to the spring plates 6 to change over the movable contacts from the NC side fixed contacts to the NO side fixed contacts in the respective switching sections A and B. After the longer ends 17*b* of the coil lead terminals 17 are connected to the coil terminals 18 in the thus fixed position of the block 9, a covering case 27 is fitted to the base over the electromagnet block 9, respective switching sections A and B and coil terminals 18.

In the case of the 4T type electromagnetic relay, four switching sections A–D respectively arranged in the same manner as in the case of the foregoing 2T type relay are provided at each corners of the base 8 of the switching block which is elongated about double in the longitudinal direction. The respective terminals 3, 4 and 7 in the additional two sections C and D are arranged in symmetrical relation to those in the sections A and B as in FIG. 7 with respect to the coil terminals 18.

With reference to FIGS. 2 to 6, a method according to the present invention for manufacturing the electric switching block as has been disclosed shall now be referred to. As shown fragmentarily in FIG. 3, the respective terminals 3, 4, 7 and 18 for the respective switching sections A and B or A to D are all integrally formed as projected from a common continuous strip or hoop S respectively at intervals required for the arrangement in the section, by a punching or the like. In this case, only the substantially reverse Z-shaped fixed contact terminal 4 is inclined away from the other fixed contact terminal 3 with respect to the strip S and the lower part forming the terminal pin 4*a* is joined to the strip through a narrowed connection 4*e*.

The particular terminal 4 is then subjected to a bending work, so that the lower terminal pin part 4*a* will be made partly perpendicular with respect to the plane of the strip S at a part shown by 4*a*′ in FIG. 3 over a length corresponding to the predetermined opposing space between both fixed contact terminals 3 and 4, as shown in FIG. 4.

The thus bent terminal 4 is thereafter bent at the portion of the narrowed connection 4*e* toward the terminal 3 so as to be erected with respect to the strip S, so that the upper end 4*c* of the terminal 4 will oppose the upper end of the terminal 3, as shown in FIGS. 5A and 5B.

Two of the thus processed strips S are arranged in parallel and spaced apart by a desired distance corresponding to that in the desired arrangement in the relay as shown in FIG. 2 or 7, so that respective sets of the terminals 3, 4, 7 and 18 on the respective strips S will be in alignment with each other. In this respect, it is advantageous to form the strip in a hoop, which is arranged to be a narrow rectangular shape so as to oppose two parts in parallel and spaced by the desired distance and to be simultaneously processed.

A desired number of pairs of the thus parallel opposing sets of the terminals, depending on whether the 2T or 4T type is being formed are thereafter subjected to a mold forming of the base 8 so as to embed therein the intermediate portions of the respective terminals 3, 4, 7 and 18 including a transverse part 4*b* of the Z-shape and bent part 4*a*′ as shown in FIG. 6. Finally the thus integrally combined terminals are separated from the strip S by being cut along depicted chain line of FIG. 6.

The thus separated groups of the respective terminals 3, 4, 7 and 18 is shown in FIG. 2, in which two of the terminal groups are arranged in parallel with each other in a direction transverse to the longitudinal axis of the base 8 so as to be adapted to the arrangement of such 2T type electromagnetic relay as shown in FIG. 7 with, the respective terminal groups forming the switching sections A and B. While the coil terminal 18 is shown to be single in each of the groups shown as adapted to a single wound coil of the electromagnet block, it may be easily provided to be two when the coil is wound in the two sections. It may be advantageous, further that the fixed contacts 1 and 2 and notch 19 are preliminarily provided to the fixed contact terminals 3 and 4 and coil terminal 18 at least before the step of bending the terminal 4, and that the movable contact spring plate 6 carrying the movable contacts is secured to the terminal 7 when the assembly shown in FIG. 2 is achieved. In the case of FIG. 2, further, the respective fixed contact terminals 4 in the two terminal groups are bent in the same direction with respect to the longitudinal axis of the base 8, buy they may be bent respectively in opposite directions with respect to the longitudinal axis of the base.

The completed state of the electric switching block according to the present invention is shown in FIG. 2 having such structure as has been referred to.

In the case when the 4T type electromagnetic relay is intended, the fixed contact terminals 3 and 4 and movable contact terminals 7 of the respective groups should be provided in the respective opposing strips S to be symmetrical with respect to the coil terminals 18 on the axis of the base 8, and the base 8 should be mold formed to integrally hold four of such symmetrical terminal groups so as to provide the four switching sections A to D.

In molding the insulative base 8, a molding die comprising upper and lower die members and a pair of both side cores is employed. In this case, the upper die can be easily adapted to a simpler and widely opened space between the respective parallel arrays of the terminals, except for the opposing fixed contact gaps, to define the upper surface of the base 8.

While the method of the present invention has been described with reference to the fixed contact terminal 4 formed substantially in the reverse Z-shape as seen in either of FIGS. 2 to 6, it should be readily understood that the shape is not limited thereto but the method of the present invention is similarly applicable to such other shape of the fixed contact terminal 4 as shown, for example, in FIG. 8. In the case of FIG. 8, the terminal 4 is formed to be provided with a laterally projected part 4*d* on one side edge of the upper end part 4*c* erected from the transverse part 4*b* so as to be substantially an M or W-shape as a whole. This projected part 4*d* is brought into opposing relation to the other fixed contact terminal 3 while the erected upper end part 4*c* is deviated from a position of opposing the other terminal 3 so as to be out of the opposing relation. In this case, the deviated upper end part 4*c* of the fixed contact terminal 4 provides a space below the laterally projected part 4*d* so that the respective side cores of the molding die can reach the other fixed contact terminal 3 through this space, whereby the upper surface of the base 8 can be completely defined by the side cores in conjunction with the upper die member. In this connection, it is advantageous to form the fixed contact terminal 4 so as to be provided with the laterally projected part 4*d*.

In either case of the respective shapes of the fixed contact terminal 4 to be opposed at least at its part carrying the fixed contact to the other fixed contact terminal 3, the terminal 4 is prepared in the same metal strip S as the one in which the other terminals 3, 7 and 18 are provided. Thus the required punching work can be reduced to be once for all; the manufacturing steps of the switching block can be thereby remarkably simplified as compared with the conventional method of FIG. 1 wherein one of the pair of opposing fixed contact terminals is prepared separately and any possibility of the positional error occurrence as in the case of the conventional method can be well eliminated.

What is claimed is:

1. A method of manufacturing a switching block of an electromagnetic relay of the type comprising:

an insulative base, a plurality of switching sections carried by said base, each switching section including a pair of fixed contact terminals embedded in said base, a resiliently movable contactor having a movable contactor terminal embedded in said base, and a coil terminal embedded in said base, and an electromagnetic block having a movable armature disposed between said switching sections to move said resiliently movable contactors, said method comprising the steps of:

(1) forming two contact parts, wherein each contact part comprises an elongate metal strip carrying said pair of fixed contact terminals, said movable contactor terminal, and said coil terminal; one of said fixed contact terminals being of zig-zag shape and inclined away from the other fixed contact terminal;

(2) arranging said two contact parts in parallel relationship;

(3) bending an intermediate portion of said zig-zag shaped fixed contact terminal so that said intermediate portion lies perpendicular with respect to the plane of said strip, the length of said intermediate portion corresponding to a predetermined distance between said pair of fixed contact terminals, (4) straightening said zig-zag shaped fixed contact terminal by moving the latter toward the other fixed contact terminal such that an end of said zig-zag shaped terminal lies opposite an end of said other fixed contact terminal, (5) molding said insulative base in a manner embedding at least two of said contact parts therein, such that said fixed contact terminals, said movable contact terminal, and said coil terminal of each contact part are embedded in said base intermediate their ends; and (6) separating said strips from the remainder of said contact parts.

* * * * *